United States Patent [19]

Hollick

[11] 4,127,910

[45] Dec. 5, 1978

[54] PROCESS FOR STIFFENING FLEXIBLE SHEET MATERIAL

[75] Inventor: John G. Hollick, Beverly, Mass.

[73] Assignee: USM Corporation, Farmington, Conn.

[21] Appl. No.: 806,559

[22] Filed: Jun. 14, 1977

[51] Int. Cl.[2] ..... A43D 00/00

[52] U.S. Cl. ..... 12/146 D

[58] Field of Search ..... 12/146 R, 146 D, 146 S, 12/142 F

[56] References Cited

U.S. PATENT DOCUMENTS

| | | | |
|---|---|---|---|
| 3,316,573 | 5/1967 | Chaplick et al. | 12/146 D |
| 3,973,285 | 8/1976 | Babson et al. | 12/146 D |

*Primary Examiner*—Patrick D. Lawson

*Attorney, Agent, or Firm*—Benjamin C. Pollard; Richard B. Megley; Vincent A. White

[57] ABSTRACT

Process for stiffening a selected are of flexible sheet material, particularly a part such as the counter portion of a shoe upper, in which a predetermined quantity of hot molten resin is deposited on the area as a body of substantial thickness, the area is pressed to spread out and adhere the resin as a layer and thereafter the resin is cooled to a stiff resilient condition. The sheet material may be removed from the first pressing operation and subjected to a second pressing or molding operation around a form such as a last. In this second pressing, molten resin which has been squeezed from the area onto the lasting margin, by controlled conditions in the first pressing may be employed as lasting cement by wiping down the lasting margin against the bottom surface of an insole.

10 Claims, 8 Drawing Figures

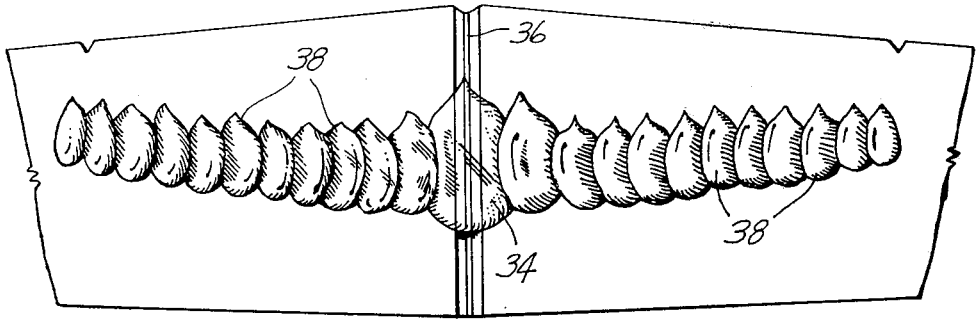
Fig. 4
Fig. 5
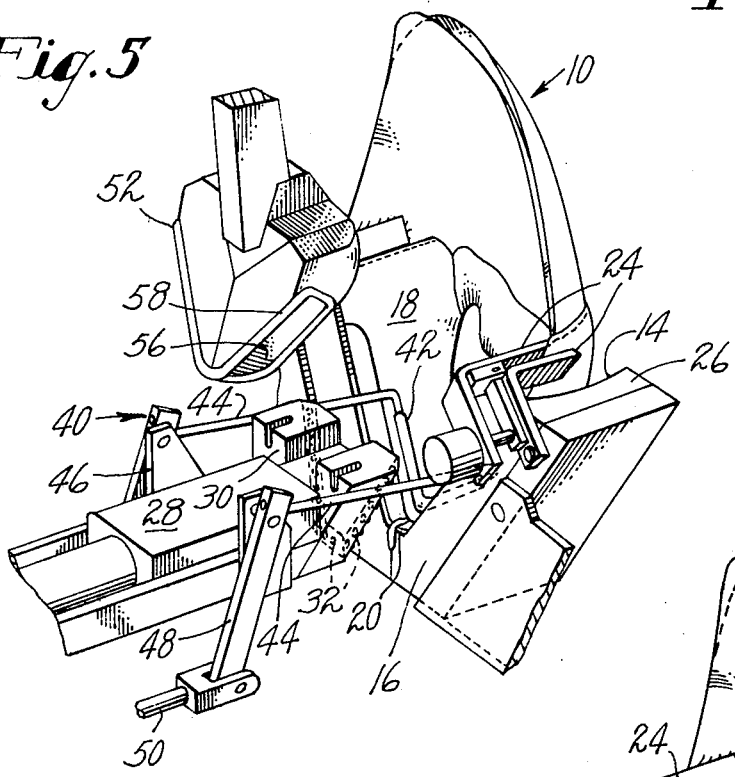
Fig. 6
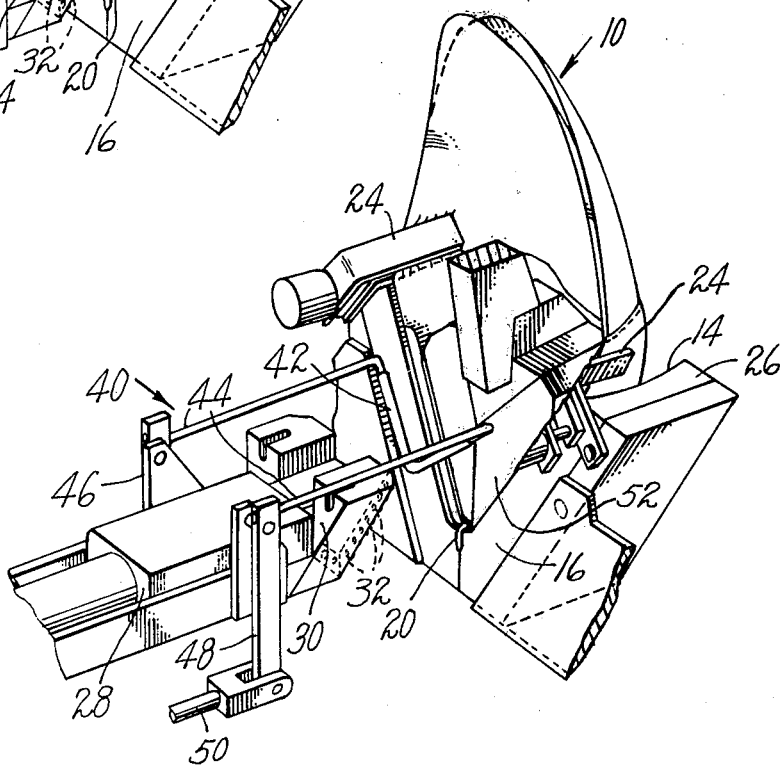

PROCESS FOR STIFFENING FLEXIBLE SHEET MATERIAL

FIELD OF THE INVENTION

This invention relates to a process for stiffening an area of flexible sheet material, and particularly for lasting and stiffening a portion of a shoe upper.

BACKGROUND OF THE INVENTION

Stiffening of portions of shoe uppers by coating the portion to be stiffened with a layer of molten resin and solidifying the resin was disclosed in the U.S. Pat. to Chaplick et al. No. 3,316,573. In the process of that patent, molten thermoplastic polymeric material was spread as a layer on a shoe upper at a temperature at which the thermoplastic material has a viscosity low enough to wet and adhere to the surface of the article to be stiffened but sufficiently high so that it will substantially not penetrate the shoe component, and the layer of material so formed was cooled and shaped to form a stiff, resilient layer holding the article in the desired configuration.

The process referred to has entered into substantial commercial use for the stiffening of toe portions of shoes; but heel portions of shoes because of the relatively small radius curves and the seam, have not lent themselves to deposition of a useful thermoplastic material stiffening layer by procedures shown in the patent.

Stiffening of portions of shoes by disposing them between mating mold halves and injecting molten stiffener material between the shoe upper layers in the mold has been proposed. However, this method has severe economic and operational difficulties which have prevented its acceptance. That is, the special two-part mold is costly particularly since different molds would be required for every distinct style of heel end and in some cases different molds would be required for different sizes of the same style. Further disadvantages are that since molten resin is introduced between two layers of shoe material, dissipation of heat to allow stiffening of the resin is retarded by the heat insulating action of the shoe upper materials so that the "in mold" time is long. Also, the thickness of the resin layer formed is dependent on the space left in the mold between the layer of upper material and the liner and hence varies inversely as the thicknesses of the upper material and liner which in the case of leather are known to be highly variable even between the two sides of a shoe.

A further procedure for stiffening portions of shoes involves the disposition of a thermosetting material on a stiffener blank or on a portion of the upper by means of a special distributor head. This distributor head squeezes out a pattern of a pasty material from a series of extruder orifices in a plate pressed against the blank or shoe upper and this pattern is spread as a uniform layer by applying pressure to flow the material over the selected area of the shoe component. Because of "stringing" and other problems this procedure is not suitable for application of molten resinous stiffeners.

SUMMARY OF THE INVENTION

It is an object of the present invention to stiffen a selected area of flexible sheet material such as a shoe upper through a method including a special procedure for forming a layer of resin from hot molten resin, which is particularly adapted for use in stiffening of heel end portions of a shoe upper.

Another object of this invention is to provide a method for stiffening the end portions of footwear, particularly the assembly and forming by applied hot melt of counter portions with or without liners.

To these ends and in accordance with a feature of the present invention, I have provided a process whereby a relatively thick deposit of molten resin is deposited on the area to be stiffened and is spread over that area by pressing the area to cause the molten resin to flow and spread out as a layer on the sheet material.

It is a further feature of the present invention to provide a process in which molten resin is spread over an area of flexible sheet material to be stiffened by a first pressing action and in which the sheet material is molded to a desired three dimensional shape and is secured in lasted relation to an insole in a further molding step where both the initial pressing and the ultimate molding step are carried out while the resin is in heat moldable condition.

DESCRIPTION OF THE DRAWINGS

Reference is made to the drawings forming part of the present case in which:

FIG. 4 is a partial plan view of the interior surface of the back part of the shoe upper showing one pattern of deposition of molten resin;

FIG. 5 is an angular view of the apparatus shown in FIG. 1 but with the parts of the apparatus in the relative position occupied during repositioning of the liner after deposition of resin;

FIG. 6 is an angular view of the apparatus shown in FIG. 1 but with the parts of the apparatus in the relative positions occupied during the resin-spreading pressing step;

DESCRIPTION OF THE PREFERRED EMBODIMENT

The process of the present invention forms a stiffener for flexible material, particularly an end portion of a shoe, by a special procedure for forming a layer of molten resin on the area of the sheet material to be stiffened, shaping the sheet material after deposition of the resin and while it is still molten, and cooling the resin to stiff, resilient condition retaining the shape of the sheet material. In further discussion, the process will be described in application to the stiffening of a backpart or counter portion of a shoe but it will be understood that the process and illustrative machine are useful in other relations, for example in stiffening the toe portion of a shoe.

Figure 1:
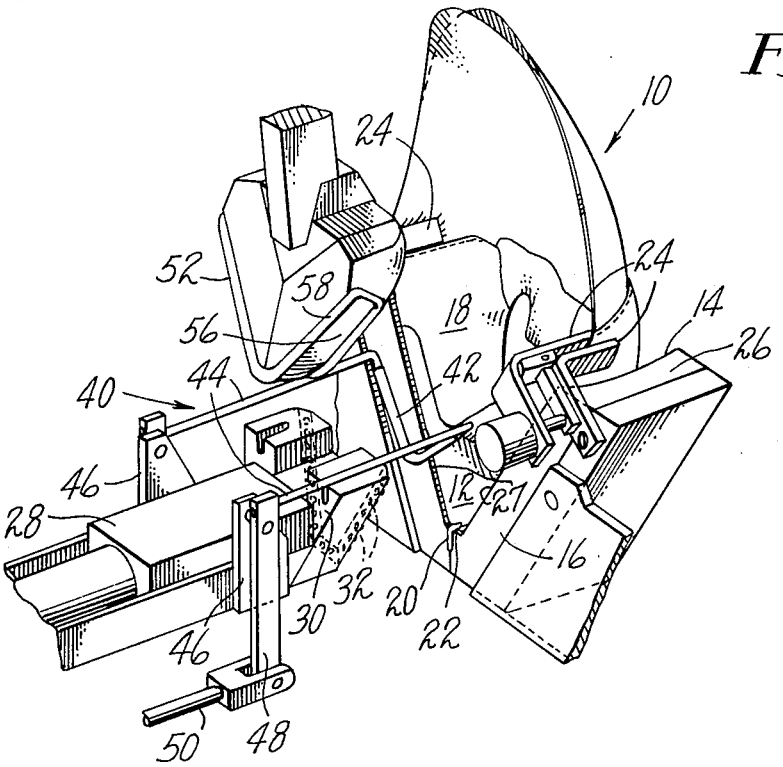
FIG. 1 is an angular view with parts broken away of one form of apparatus useful in practicing the process of the present invention, showing a shoe upper clamped in position and the parts of the apparatus in their relative position at the start of the process.
Figure 2:
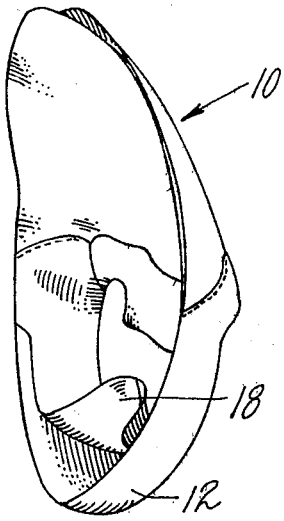
FIG. 2 is an angular view of a shoe upper with the lining folded back as the upper is arranged in the apparatus of FIG. 1.

As shown in FIG. 1, a shoe upper 10, of which the heel end portion is to be stiffened, is disposed with the outer layer 12 of the upper 10 held adjacent inner surfaces 14 of a first press member 16 of the machine of FIG. 1 with a lining 18 folded back leaving the interior surface of the outer layer 12 of the shoe upper 10 exposed. The upper 10 is clamped with the process surfaces 14 in position to act on it by jaws 20 which hold the back of the shoe upper 10 adjacent the vertex 22 of the surfaces 14 of the press and by pincers 24 which grip bottom edges of the shoe upper 10 at position above the upper edges 26 of the press surface 14, i.e., beyond the breast line.

A preferred form of press member 16 shown in FIG. 1 is generally internally V-shaped and the press surfaces 14 are dished or curved with a relatively large radius (on the order of about 8 inches, for instance) about an axis substantially parallel to lengthwise work engaging elements or edges such as at 27 of the press surfaces. At the vertex 22 between these surfaces, 14, the line of juncture between the two curved surfaces forms an elliptic shape which approximates the curve of the back extremity of the upper. The dihedral angle between the two press surfaces 14, 14 will be between about 15° and 75°, preferably between 30° and 60°.

Figure 3:
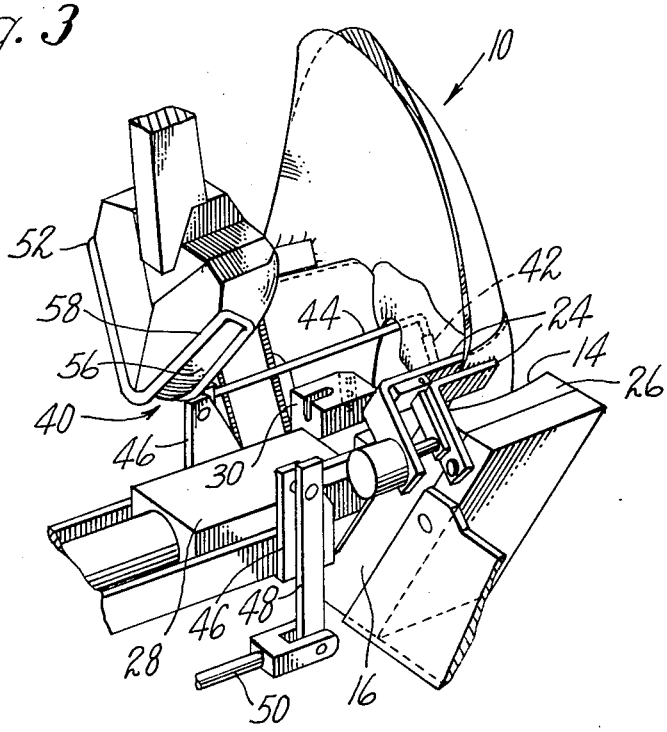
FIG. 3 is an angular view of the apparatus shown in FIG. 1 but with the parts of an extruder and presser of the apparatus in the relative positions occupied during deposition of molten resin.
Figure 8:
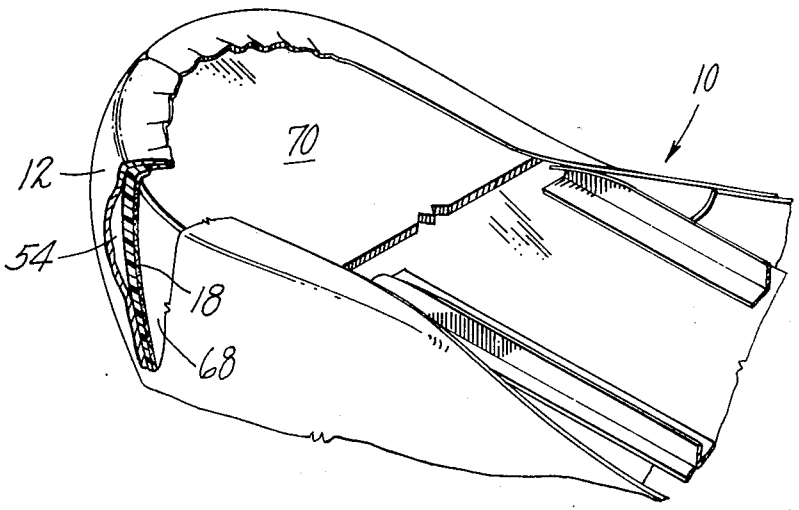
FIG. 8 is an angular view with parts broken away showing a lasted back part of a shoe upper with a stiffener layer formed by the process between the layers of the shoe upper.

An extruder 28 of the machine for depositing molten thermoplastic material is mounted for relative movement from a first inoperative position, shown in FIG. 1 in which it leaves the press member 16 clear for mounting the shoe upper 10, to a second position shown in FIG. 3 in close relation, suitably from about 0 inch to about 0.300 inch from the suspended shoe upper for depositing the material as relatively thick bodies preferably from about ⅛ inch to about ⅜ inches in thickness on the area to be stiffened. As shown in FIG. 1, an extruder head 30 of the machine has a series of holes 32 from which molten resin is ejected onto the inner surface of the outer layer 12 to form bodies of resin on each side of the back extremity and a body of resin extending across the back of the shoe upper.

The extruder head 30 preferably is constructed to eject molten resin as coherent charges from the holes 32 at an angle, suitably about from 30° and 60° to the interior surface of the outer layer 12 so as to avoid objectionable build-up of a mass of resin extending between the extruder head and that surface. That is, in the preferred operation, molten resin deposits initially as discrete blobs on the outer layer 12 at a location forward of the extruder head 30 and does not pile up on the layer 12 to an extent to foul the extruder head 30. Also, it is observed that later ejected portions of molten resin from the respective nozzles tend to push earlier portions forward away from the extruder head 30 along the surface of outer layer 12 to form connected resin bodies having the shape shown in FIG. 4. A further advantage is that the last ejected portions of molten resin are at highest temperature so that tendency for stringing between the extruder head 30 and the deposited resin when the extruder head is withdrawn is minimized.

It is desirable that the bodies be of such quality and so distributed as to minimize the distance the molten material must flow to cover the area to be stiffened. One useful deposition pattern is shown in FIG. 4 in which a body 34 of thermoplastic material extends across a seam 36 at the back of the upper and smaller bodies 38 of the material extend in contiguous relation. Any convenient type of hot melt extruder 38, but preferably embodying angularly directed nozzles as noted, may be used, for example, a pump supplying molten material from a reservoir, or a melter extruder of the type used for injection molding of plastics, or a melting device for converting pellets or successive portions of the length of a rod, coil or bar of thermoplastic material to molten state. The quantity of molten material deposited will be predetermined to give that quantity of resin which when thereafter spread as a layer will give a thickness sufficient to provide desired stiffness when cooled and solidified in the end portion of the shoe. With a preferred form of the process including the step of lasting of the heel end portion, a further quantity of molten material will also be supplied such that after distribution of the resin as a layer in the area to be stiffened, additional resin will be available from the deposit for distribution to the lasting margin of the back part of the upper to adhesively secure the lasting margin to an insole.

Promptly after deposition of the molten material on the shoe upper, preferably while it is being suspended by the pincers 20, 24, the lining 18 will be unfolded and moved back over outer layer 12 of the upper with the bodies 34 and 38 of molten material between the layer 12 and the liner 18. Such repositioning of the lining 18 is preferably effected by a device such as a reciprocable spreader 40 but may be accomplished by hand if desired.

As shown in FIG. 1, the spreader 40 has a V-shaped portion 42 interconnecting the ends of rod portions 44 pivotally mounted on brackets 46 secured to the extruder 28. Levers 48 connected to the rod portions are movable by a connecting rod 50 to raise and lower the V-shaped portion 42. The spreader arm 40 is moved forward, e.g. toward the upper 10, with the portion 42 raised (see FIG. 1) when the extruder 28 moves forward to a position above and behind the lining 18, (see FIG. 3), and is lowered and moved back when the extruder 28 is withdrawn after depositing molten material (see FIG. 5). The backward movement of the V-shaped portion 42 lays the lining 18 down on the molten material, whereupon the portion 42 is retracted to an out-of-the-way position. The pincers now hold the work into the V-like cavity of the member 16 serving as a work support or mold member.

At this stage, a second press member 52 (FIGS. 1, 3, 5 and 6) generally complementary to the press member 16 is relatively moved (See FIG. 6) to press the assembly of outer layer 12, deposited molten thermoplastic material and liner 18 to squeeze the thick bodies 34 and 38 of molten material and cause them to flow out, merge and spread into a substantially uniform layer 54 between the confronting surfaces of the upper material and liner.

Where the press members 16 and 52 have a general V-shaped form, the members coact using the principle of the inclined plane to give a mechanical advantage so that a force pressing the apex of the second press member 52 towards the apex of the first press member 16 is amplified to give a higher force pressing the inclined surface 56 of the second press member 52 toward the adjacent surfaces 14 of the first press member 16.

The outer layer 12 or the outer layer 12 and lining 18 may be pinched by a resilient linear member 58 on the surfaces 56 of the second press member along a line serving to define and limit the outward flow of the molten material.

The resilient linear member 58 may be located to effect a seal with the lasting margin 60 of the outer layer 12 with the heel portion of the shoe upper below the bottom edge 62 of the liner 18. Squeezing of the assembly between the pressure forces molten thermoplastic material out past the bottom edge of the liner to form a bead 64 of molten thermoplastic material on the surface of the lasting margin 60 between the edge 68 and the member 58. The bead 64 may be employed as a heel seat lasting adhesive at a later step.

Figure 7:
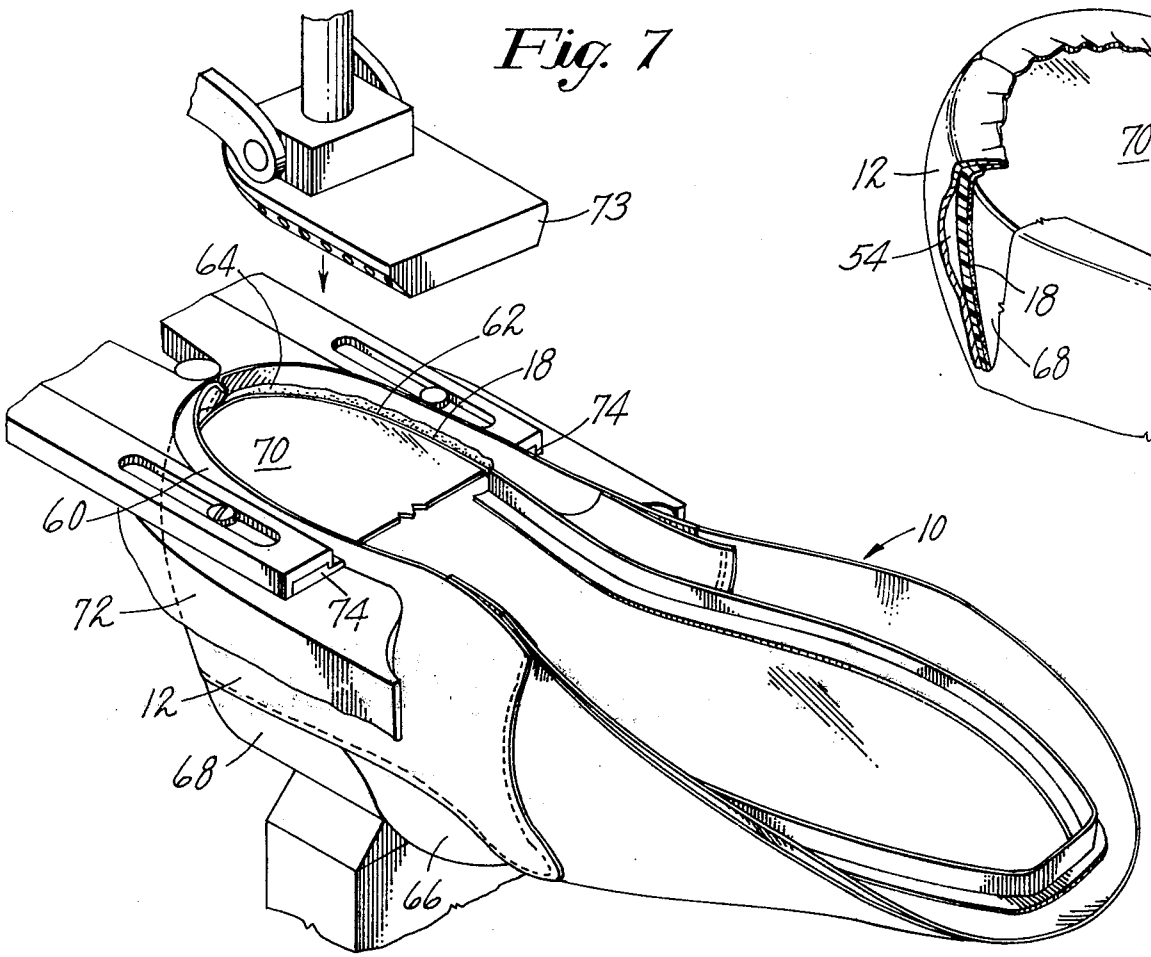
FIG. 7 is an angular view showing disposition of the shoe upper during heel-seat lasting after the shoe upper has been subjected to the steps shown in FIGS. 1 through 6.

The press surfaces 14 and 56 may be moved apart and the shoe upper 10 removed following the pressing step and the layer 54 of material between the outer layer 12 and the liner 18 formed by the pressing step will preferably remain deformable for a period of upwards of a minute to the extent that even thumb pressure against the upper would form a dimple or depression. With the resin in this deformable condition, the shoe upper 10 may be subjected to back part molding and preferably heel seat lasting. Thus, (see FIG. 7) the upper 10 is disposed with the heel end portion in contact with a forming member shown as the heel portion of a last 66 mounted on a modified back part molding and heel seat lasting machine and with a lasting margin 60 forming a wall around the heel end 68 of the last 66. An insole 70 is disposed on the bottom of the last 66 in position for the lasting margin 60 to be wiped inwardly over it in a heel seat lasting operation. Pincers (not shown) grip the toe end of the shoe upper 10 to pull the shoe upper into snug engagement with the heel end 68 of the last and a back part molding band 72 is pressed firmly against the shoe upper 10 to force it into molding engagement with the heel portion of the last 66.

The bead 64 of thermoplastic material on the lasting margin 60 is preferably subjected to a heating operation to render it more freely flowable. This heating may conveniently involve directing heated air from heater head 73 against the bead 64 of thermoplastic material and/or the lasting wiper blades 74 may be heated. When the thermoplastic material is fluid with a viscosity enabling it to enter into wetting adhesive engagement with the lasting margin surface, wiper blades 74 are actuated in conventional manner to wipe the lasting margin 60 into engagement with the bottom of the insole 70, the wiping being effective to flow the molten thermoplastic material of the preformed bead 64 ahead of the nip between the insole and the lasting margin so that the material enters into wetting adhesive engagement with both the bottom of the insole 70 and the lasting margin 60 of the shoe upper 10 to effect cement heel seat lasting.

In a modification of the process, a press member (not shown) is employed having press surfaces three-dimensionally curved to a shape complimentary to the shape of the heel end of an upper; and pressure of the mating press surfaces acting on the assembly of upper material, molten thermoplastic material deposited as aforementioned and lining is maintained for a period sufficient for the material to cool to a shape-retaining condition. With this modification the back part molding operation may be eliminated. However, this form of process is slower since it ties up the press associated with the hot melt supply device 28 or equivalent during the extended cooling period. Also, there is difficulty in insuring uniformity of thickness of the polymeric material layer with upper materials of non-uniform thickness, particularly where there is substantial difference between the thicknesses of the two quarters.

Polymeric material useful for stiffening flexible sheet material in the process of the present invention may be any material reducible by heat to molten condition with a viscosity low enough to flow into wetting adhesive engagement with the sheet material but with the viscosity high enough to avoid substantial penetration into the fibers of the sheet material and which material has a stiffness, strength and toughness to provide in the layer of suitable thickness the strength and shape retension required. Among such useful materials are polyamides, polyesters such as the terephthalic and isophthalic polyesters discussed in U.S. Pat. No. 3,316,573, polyesteramides, high density and low density polyethylenes, polypropylenes, ionomers, ethylene vinyl acetate copolymers and ethylene ethyl-acrylate copolymers and so on. In addition to the preceding which are thermoplastic polymeric materials, it is also possible to employ materials which are heat fusible but which may subsequently be cured to a non-thermoplastic condition. Preferred polymeric materials will have a melt index at 374° F. (190° C.) and 2160 grams, (which is condition E of ASTM 1238) of from about 0.8 to about 300, preferably from 5 to about 50.

For effective spreading to insure a layer of uniform thickness, it appears desirable to supply sufficient molten material such that the central portions of the area to be stiffened have a thickness after pressing of from about 0.030 inch to about 0.10 inch. Also, it appears desirable that the quantities of material be supplied as an elongated body for example by depositing the molten material from a plurality of extrusion orifices arranged along a line from $\frac{1}{4}$ to $\frac{3}{4}$ of the distance from the lower edge of the heel end portion of the shoe to the top line at the heel end portion of the shoe.

For the intended use in stiffening portions it is desirable to supply a material to the shoe upper at a temperature of from about 275° F. to about 500° F. preferably from about 300° F. to about 450° F. This temperature must be high enough to insure that the deposited quantities of material will unite integrally without lines of weakness between bodies of material from separate orifices, when the polymeric material is spread by pressing and molding operations.

By depositing the molten polymeric material in bodies which are from about 0.15 inch to about 0.4 inch thick, it has been found not only that "string forming" is reduced when the depositing nozzles are moved away from the deposited resin but also that because of the low ratio of surface area to volume, the material will remain hot and in useful workable molten condition to insure good spreading and wetting for substantially longer periods than if the material were initially more spread out.

Pressures of from about 50 to about 400 psi between the surfaces of the press member have been found effective to squeeze and spread the deposited bodies of molten polymeric material over all portions of the area to be stiffened and to insure firm knitting of molten material where the material deposited from separate extrusion orifices comes together during the pressure spreading step. Careful control of quantity and disposition has been found effective to eliminate the need for extending the linear members 58 around the end edges away from the heel end of the area to be stiffened. As noted above, where the press members have a general V-shape, a mechanical advantage is secured so that, for example with a dihedral angle of 45° between the surfaces of the first member and with a counter area of 18 square inches a force of only 350 to 3,000 pounds pressuring the second press member into the first is effective to give the desired squeezing pressure of 50 to 400 psi, rather than the force of 900 to 7,200 pounds needed without this advantage.

The following example is given to aid in understanding the invention and it is to be understood that the invention is not limited to the particular materials, conditions or special procedures and apparatus referred to in the example.

EXAMPLE

A leather shoe upper with leather quarter liner having its lower edge terminating just below the heel seat lasting margin was clamped by jaws and pincers in a V-shaped press member with the liner folded back as shown in FIG. 1. The press surfaces were curved on a radius of 8 inches about an axis parallel to the lengthwise edges of the press surfaces and the dihedral angle between the surfaces was about 44°. The line of juncture between to two curved surfaces formed a portion of an ellipse approximating the curve of the back extremity of the upper.

An extruder like that shown in FIG. 1 was charged with ethylene-vinyl acetate copolymer resin having a melt index of 20.0 and the resin was melted and brought to a temperature of about 375° F. The extruder was moved forward to the position shown in FIG. 3 and caused to deposit a 16 gram body of resin in molten condition on the shoe upper in a pattern like that shown in FIG. 4. After deposition, the extruder was drawn back and the liner positioned on the deposited resin by the spreader as shown in FIG. 5.

The assembly of shoe upper, molten resin and quarter liner was then pressed by a second press member generally complementary to the V-shaped first press member as shown in FIG. 6. The press surface of the second press member was provided with resilient linear members for limiting the outward flow of resin when the assembly was pressed. The second press member has a slightly larger dihedral angle, i.e., an angle of 45°, than the first press member so that the gap between surfaces of the first and second V-shaped press members tapers from back to front. Thus, the thickness of the layer of the resin in the present example was about 0.070 inches adjacent the back seam of the shoe upper and only 0.025 inches at a point 4 inches forward of the back seam on each side. The pressure also caused flow of the molten resin past the lower edge of the quarter liner to form a bead available as a heel seat lasting adhesive on the surface of the shoe upper material between the lower edge of the quarter liner and the resilient linear member on the surface of the second press member. To effect flow of the molten resin between the shoe upper and the quarter liner, a force of 2,000 pounds was applied to press the second press member towards the vertex of the first press member. Because of the mechanical advantage secured by reason of the angular relation of the press surfaces this force of 2,000 pounds generated a force of about 5,000 pounds between the press surfaces so that with an 18 square inch area of the counter, a pressure of about 280 psi was exerted to cause flow and distribution of the molten resin.

After maintaining the pressure on the shoe upper assembly for about 5 seconds, the press members were separated, the shoe upper was removed and was mounted on a last carrying an insole with the last margin extending around the insole and the bead of molten resin located on the lasting margin in a position exposed above the insole. The last with the shoe upper and insole thereon was positioned in a heel seat lasting and backpart molding machine and the adhesive bead subjected to a blast of hot air from a distributor head to bring it to hot condition easily spreadable for wetting adhesive engagement on a surface. The backpart molding machine was then operated to pull the toe end of the shoe upper forward to bring the backpart of the shoe upper into snug engagement with the surface of the last, and the backpart molding band was operated to press firmly against the back portion of the shoe upper. The heel seat lasting wiper blades were activated to wipe the lasting margin of the shoe upper into engagement with the bottom of the insole and this wiping operated to flow the molten thermoplastic material of the bead ahead of the nip between the insole and the lasting margin to establish wetting adhesive engagement with both the insole and the lasting margin of the shoe upper. After a 20 second dwell, the shoe upper was removed from the backpart molding and heel seat lasting machine.

The resulting shoe was completed and it was found that the counter formed from the molten resin stiffened the backpart of the shoe resiliently to maintain it in shape.

Having thus described my invention and what I claim as new and desire to secure as Letters Patent of the United States is:

1. The process for stiffening a selected area of flexible sheet material such as an end portion of a shoe upper comprising depositing a pre-determined quantity of hot molten resin as a body of substantial thickness on portions of said area, leaving other portions of said area substantially free from resin, thereafter pressing said area of sheet material and resin together against a press surface while said resin is in hot molten condition to cause said molten resin to flow and spread as a layer substantially thinner than said body of resin extending over said other portions in wetting substantially non-penetrating relation to sheet material throughout said area, forming said sheet material to a pre-determined three dimensional shape while said resin remains in hot moldable condition and cooling said resin layer to a stiff resilient condition firmly bonded to said sheet material to hold said area substantially in said pre-determined shape.

2. The process for stiffening a selected area of flexible sheet material as defined in claim 1 comprising assembling a second sheet material against said body of hot molten resin pressing the assembly to flow said resin between said sheet materials into wetting, adhesive, substantially non-penetrating relation throughout said area.

3. The process for stiffening an end portion of a shoe upper as defined in claim 2 in which said molten resin is ejected as coherent charges at an angle of from about 30° to about 60° to the surface of said selected area to avoid objectional build up of a resin mass extending between said depositing means and said area.

4. The process for stiffening an area of flexible sheet material as defined in claim 3 comprising pressing the assembly of sheet material and resin against a surface having a contour for imparting a predetermined three dimensional shape to conform it to said contoured surface while said resin is in hot moldable condition, and in which said resin layer resiliently holds said area substantially in said predetermined shape after said cooling.

5. The process for stiffening an area of flexible sheet material such as an end portion of a shoe upper comprising depositing a pre-determined quantity of hot molten resin as a body of substantial thickness on portions of said area, leaving other portions of said area free from resin, assembling a second sheet material against said body of hot molten resin, thereafter pressing the assembly of sheet materials and resin against a first press surface while said resin is in hot molten condition to cause said resin body to spread and flow out as a layer substantially thinner than said body of resin between said sheet materials extending over said other portions into wetting, adhering substantially non-penetrating relation throughout said selected area, thereafter pressing said assembly against a surface having a contour for imparting a pre-determined three dimensional shape to conform the assembly while said resin is in hot moldable condition and cooling said resin layer to a stiff resilient condition in which said resin layer holds said area substantially in said pre-determined shape.

6. The process for stiffening flexible sheet material as defined in claim 5 in which said selected area is a counter portion of a shoe upper, said sheet material disposed in register with said contoured surface is the exterior layer of a shoe upper and said second sheet material is a liner, in which said molten resin is deposited as a plurality of adjacent bodies of substantial thickness and in which pressing the assembly against said first press surface causes said resin bodies to spread out and merge into an integral layer.

7. The process for stiffening a counter portion of a shoe upper as defined in claim 6 in which said first pressing comprises disposing said counter portion against a generally Vshaped first press surface with the back extremity of said counter adjacent the apex of the V and with opposing sides of the counter portion extending along the sides of the V and pressing the assembly of counter portion, molten resin and liner against said first press surface by a second press surface generally complementary to said first press surface to flow and spread said molten resin as a layer.

8. The process for stiffening a counter portion of a shoe upper as defined in claim 7 in which said counter portion is held in V-shape similar to said V-shaped first press surface during deposition of said molten resin.

9. The process for stiffening an area of flexible sheet material as defined in claim 8 comprising the step of physically limiting flow of said molten resin along a selected outline shape, said predetermined quantity of hot molten resin deposited relative to the area within said outline providing sufficient resin to flow when said sheet materials are pressed to form a layer covering said area and then having a thickness providing stiffness for maintaining said area in said three-dimensional shape when said resin layer is cooled.

10. The process for stiffening a counter portion of a shoe upper as defined in claim 9 in which said counter portion includes a lasting margin extending beyond the lower edge of said liner, said first pressing step flows resin from between said shoe upper and said liner to form a bead of molten resin on said lasting margin and in which said assembly of upper, liner and molten resin is disposed on a three-dimensionally curved contoured surface with said lasting margin in relation for wiping over onto an insole, said counter portion and liner are pressed against said contoured surface, said lasting margin is wiped over onto said insole to flow the molten resin of said bead ahead of the nip between said insole and said lasting margin to establish wetting adhesive relation of said resin on said lasting margin and said insole, and said cooling solidifies said resin to a resilient layer having a stiffness for maintaining said counter and liner in the shape imparted to them by said form and holding said lasting margin firmly in lasting relation to said insole.

* * * * *